US009151004B2

(12) United States Patent
Anderson et al.

(10) Patent No.: US 9,151,004 B2
(45) Date of Patent: Oct. 6, 2015

(54) AUTOMATED HOPPER AND APRON CONTROL SYSTEM ON A PAVING MACHINE

(71) Applicant: Caterpillar Paving Products Inc., Brooklyn Park, MN (US)

(72) Inventors: Bradley D. Anderson, Rogers, MN (US); Chad M. Thiesse, Brooklyn Park, MN (US); Toby Frelich, Saint Michael, MN (US)

(73) Assignee: Caterpillar Paving Products Inc., Brooklyn Park, MN (US)

( * ) Notice: Subject to any disclaimer, the term of this patent is extended or adjusted under 35 U.S.C. 154(b) by 68 days.

(21) Appl. No.: 14/079,708

(22) Filed: Nov. 14, 2013

(65) Prior Publication Data

US 2015/0132058 A1 May 14, 2015

(51) Int. Cl.
*E01C 19/48* (2006.01)

(52) U.S. Cl.
CPC ..... *E01C 19/48* (2013.01)

(58) Field of Classification Search
CPC ..... E01C 19/48
USPC ..... 404/101, 108, 118; 298/24–31
See application file for complete search history.

(56) References Cited

U.S. PATENT DOCUMENTS

| | | | | | |
|---|---|---|---|---|---|
| 3,880,542 | A * | 4/1975 | Mullen | 404/101 |
| 3,907,451 | A * | 9/1975 | Fisher et al. | 404/101 |
| 4,765,772 | A * | 8/1988 | Benedetti et al. | 404/77 |
| 5,356,238 | A * | 10/1994 | Musil et al. | 404/84.1 |
| 5,851,085 | A | 12/1998 | Campbell | |
| 6,193,438 | B1 | 2/2001 | Heims | |
| 6,481,925 | B1 * | 11/2002 | Olson | 404/108 |

FOREIGN PATENT DOCUMENTS

| | | |
|---|---|---|
| CN | 102653934 | 9/2012 |
| JP | 2886009 | 4/1999 |
| JP | 2009019353 | 1/2009 |

* cited by examiner

*Primary Examiner* — Raymond W Addie
(74) *Attorney, Agent, or Firm* — Andrew A. Phillips

(57) ABSTRACT

A paving machine including a right hopper, a left hopper, an apron and an automated hopper and apron control system is provided. The right hopper, the left hopper and the apron are configured to move in a vertically upward and downward direction. The automated hopper and apron control system is configured to control the movement of one or more of the right hopper, the left hopper, and the apron. The automated hopper and apron control system may include a controller. The controller is configured to operate the automated hopper and apron control system in a manual mode and an auto mode as desired by an operator. In the auto mode, the controller actuates one or more of the right hopper, the left hopper, and the apron from a first position to one of a fully raised position and a fully lowered position.

20 Claims, 4 Drawing Sheets

AUTOMATED HOPPER AND APRON CONTROL SYSTEM ON A PAVING MACHINE

TECHNICAL FIELD

The present disclosure relates to paving machines, more particularly to an automated hopper and apron control system on a paving machine.

BACKGROUND

Road construction equipment, such as paving machines, are used for constructing road surfaces by laying leveling and preliminarily compacting paving material such as asphalt. The paving material is added to the hoppers of a paving machine by a dump truck. The material is transferred from the hoppers to a hopper conveyor of the paving machine. The hoppers and apron are raised or lowered to gravity feed an optimum pile of the paving material over the hopper conveyor. The material from the hopper conveyor is conveyed to a distributing auger on a rear end of the paving machine. The distributing auger lays the material on a paving surface as a stockpile. As the paving machine moves forward, the stockpile is flattened by a screed mounted on the rear end of the paving machine. The screed compacts the material over the width of the paving surface. For a smooth paved surface, there is a need for constant speed and consistent supply of the material to the hopper conveyor. Hence, the hopper and the apron needs to be raised and lowered to maintain consistent supply of the paving material for hopper conveyor. The hoppers and apron are controlled by a control system for an up/down movement.

Traditionally, the control system includes a keypad or control panel which has a plurality of keys or buttons or switch to control the up/down movement of the hoppers and the apron. There are buttons corresponding to the up/down movements of the hoppers and the apron. An operator initiates a process of emptying the material from the hoppers and/or apron by pressing the corresponding buttons. The operator holds the buttons throughout the process of emptying the material from the hoppers and the apron, or returning the hoppers and the apron to their starting position. As the operator holds the buttons, the control system actuates the corresponding functions for which the buttons are pressed. Such a control system is exhausting, less ergonomic and tedious for the operator as the operator needs to hold one or more of the buttons of the keypad, throughout the emptying process or while returning them to their starting position. Hence, there is a need for a control system that may enable the operator to work in a productive manner with better ergonomics.

SUMMARY OF THE DISCLOSURE

It is an object of the disclosure to provide a paving machine with an automated hopper and apron control system.

In accordance with the embodiments of the present disclosure, a paving machine may include a right hopper, a left hopper, an apron and an automated hopper and apron control system. The right hopper is configured to move in a vertically upward direction and a vertically downward direction. The left hopper is configured to move in the vertically upward direction and the vertically downward direction. Similarly, the apron is configured to move in the vertically upward direction and the vertically downward direction.

In accordance with the embodiments of the present disclosure, the paving machine may include the automated hopper and apron control system configured to control the movement of the one or more of the right hopper, the left hopper, and the apron. The automated hopper and apron control system may include a controller. The controller is configured to operate the automated hopper and apron control system in a manual mode and an auto mode as desired by an operator. In the auto mode, the controller actuates the one or more of the right hopper, the left hopper, and the apron from a first position to one of a fully raised position and a fully lowered position based on operator input. In the manual mode, the controller actuates the one or more of the right hopper, the left hopper, and the apron from the first position to a second position based on the operator input.

DETAILED DESCRIPTION

Figure 1:
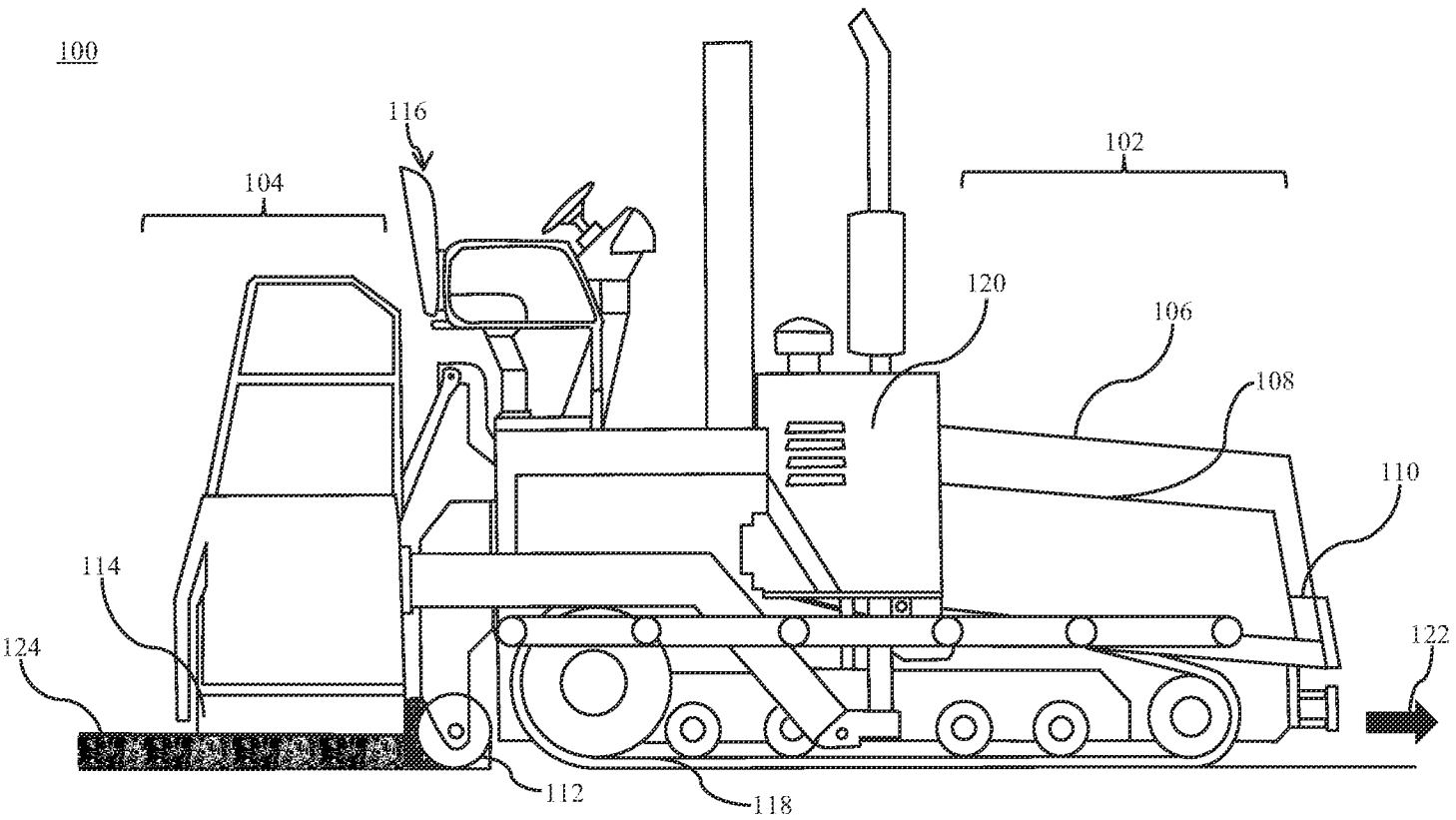
FIG. 1 is a side view of a paving machine in accordance with an embodiment of the present disclosure.

FIG. 1 is a side view of a paving machine 100 in accordance with an embodiment of the present disclosure. As shown in FIG. 1, the paving machine 100 includes a front end 102 and a rear end 104. The front end 102 of paving machine 100 includes a right hopper 106, a left hopper 108, an apron 110, and a hopper conveyor (not shown). The right hopper 106 and the left hopper 108 are configured to receive asphalt or other material from a dump truck or other material transfer vehicle. The right hopper 106, the left hopper 108, and the apron 110 are configured to move vertically upward and downward. In other words, the right hopper 106, the left hopper 108, and the apron 110 are hinged and can rotate about an axis while moving upward or downward. The movement of the right hopper 106, the left hopper 108, and the apron 110 is further described in FIG. 2. Hence, the right hopper 106, the left hopper 108, and the apron 110 are arranged and aligned to gravity feed the material to the hopper conveyor (not shown).

The rear end 104 includes a distributing auger 112 and a screed 114. The distributing auger 112 is configured to lay paving material on a paving surface as a stockpile. The stockpile is compacted by an action of the screed 114.

The paving machine 100 further includes an operator station 116 and a track drive 118 driven by an engine 120. In an alternative embodiment of the present disclosure, the paving machine 100 may include a wheeled drive, a track drive or the like. The operator station 116 houses controls for the paving machine 100 and the track drive 118. The track drive 118 is configured to move the paving machine 100 during a paving operation in a paving direction indicated by an arrow 122.

In operation, the paving material is dumped from a dump truck in a space created between the right hopper 106, the left hopper 108 and the apron 110. The paving material dumped in the right hopper 106 and the left hopper 108 is received by the hopper conveyor (not shown) mounted under the right hopper 106 and the left hopper 108. The hopper conveyor (not shown) conveys the material through a conveyor tunnel (not shown) to the distributing auger 112 located near the rear end 104 of the paving machine 100. The distributing auger 112 is configured to distribute the material received from the right hopper 106 and the left hopper 108 via the hopper conveyor (not shown). The distributing auger 112 distributes the material across the width of a paving surface. The material laid on the paving surface is paved by the screed 114 attached to the rear end 104 of the paving machine 100. The screed 114 is configured to float over the paving surface and flatten the material on the paving surface to form a mat 124.

Figure 2:
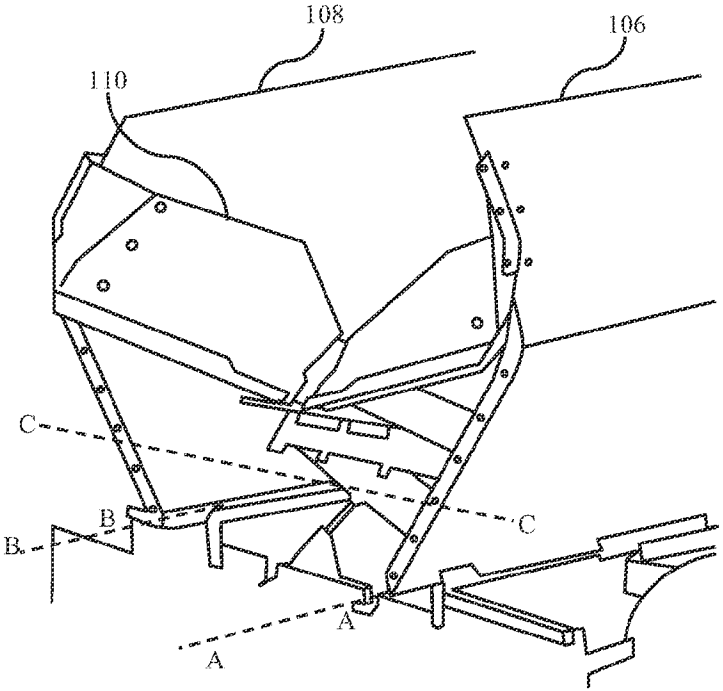
FIG. 2 is a perspective view of a front end of the paving machine showing a right hopper, a left hopper, and an apron in a fully raised position in accordance with an embodiment of the present disclosure.

FIG. 2 is a perspective view of the front end 102 of the paving machine 100 showing the right hopper 106, the left hopper 108, and the apron 110 in a fully raised position in accordance with an embodiment of the present disclosure. The fully raised position of the right hopper 106, left hopper 108, and the apron 110 is referred to an upward position at a predefined height attained by a vertical upward movement of the right hopper 106, left hopper 108, and the apron 110, respectively. As illustrated in FIG. 2, the right hopper 106 can be hinged and rotate about the axis A-A. Similarly, the left hopper 108 and the apron 110 can be hinged and rotate about the axis B-B and C-C, respectively. Hence, the right hopper 106 can be moved vertically upward to a fully raised position by rotating the right hopper 106 about the axis A-A. In a similar manner to achieve fully raised position for the left hopper 108 and the apron 110, each can be moved vertically upward by rotating the left hopper 108 and the apron 110 about the axis B-B and axis C-C, respectively. The rotation of the right hopper 106, the left hopper 108 and the apron 110 can be hereinafter referred to as vertically upward movement or downward movement. It can be contemplated that suitable hydraulic or telescopic cylinders can be used to cause the vertically upward or vertically downward movement of the right hopper 106, the left hopper 108 and the apron 110.

Figure 3:
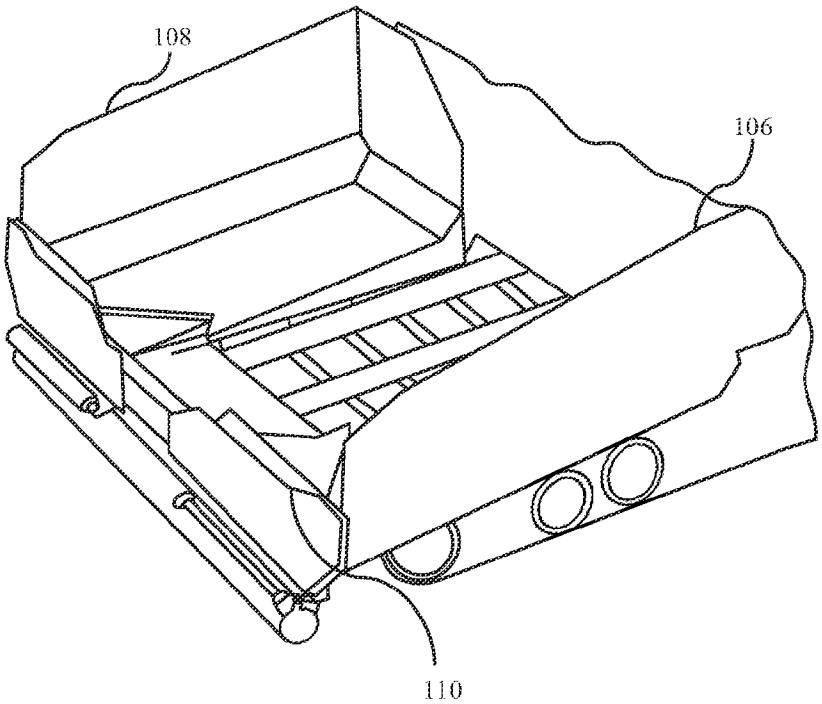
FIG. 3 is a perspective view of the front end of the paving machine showing the right hopper, the left hopper, and the apron in a fully lowered position in accordance with an embodiment of the present disclosure.

FIG. 3 is a perspective view of the front end 102 of the paving machine 100 showing a right hopper 106, a left hopper 108, and an apron 110 in a fully lowered position in accordance with an embodiment of the present disclosure. The fully lowered position of the right hopper 106, left hopper 108, and the apron 110 is referred to a downward position at a predefined height attained by a vertical downward movement of the right hopper 106, left hopper 108, and the apron 110, respectively.

Figure 4:
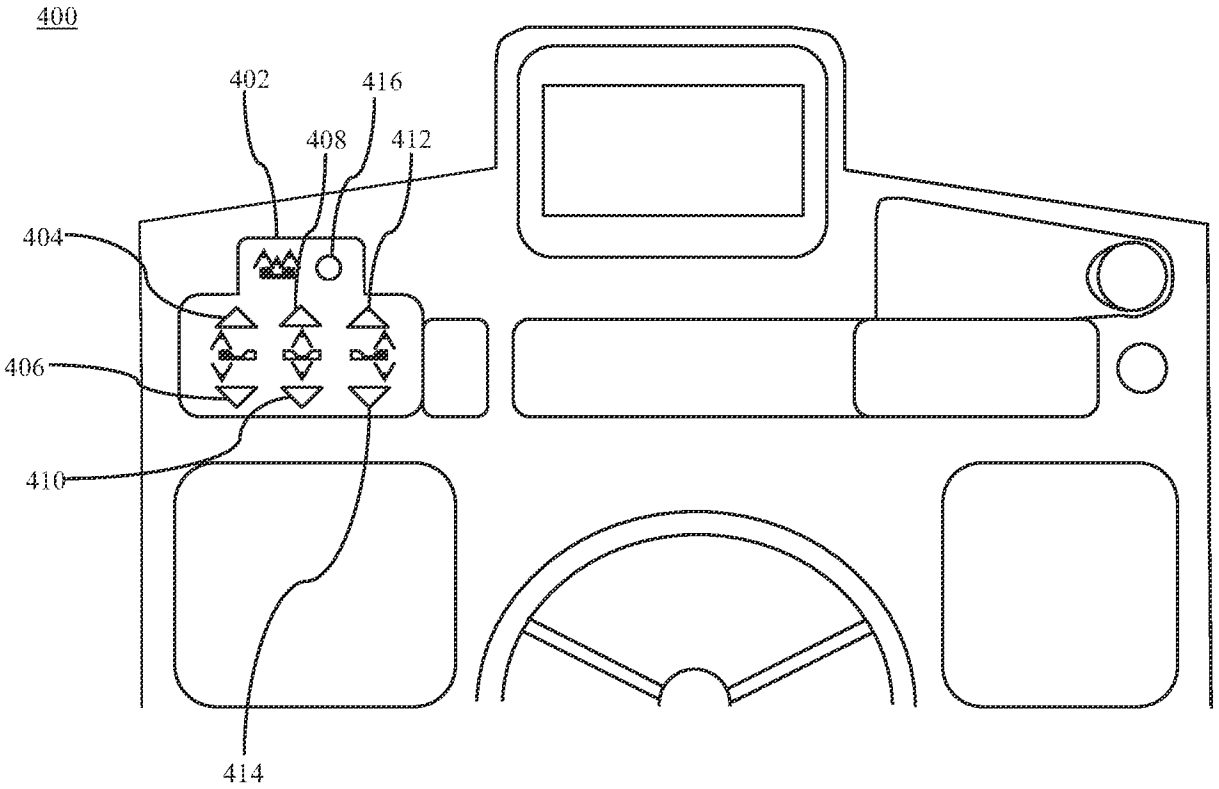
FIG. 4 is a diagrammatic illustration of a control panel with a keypad in accordance with an embodiment of the present disclosure.

FIG. 4 is a diagrammatic illustration of a control panel 400 on the paving machine 100 in accordance with an embodiment of the present disclosure. The control panel 400 is explained in conjunction with FIG. 1.

The control panel 400 may include a keypad 402. The keypad 402 may include a first button 404, a second button 406, a third button 408, a fourth button 410, a fifth button 412, a sixth button 414 and a seventh button 416.

The first button 404 may be configured to activate a vertically upward movement of the right hopper 106. The second button 406 may be configured to activate a vertically downward movement of the right hopper 106. The third button 408 may be configured to activate the vertically upward movement of the left hopper 108. The fourth button 410 may be configured to activate the vertically downward movement of the left hopper 108. The fifth button 412 may be configured to enable the vertically upward movement of the apron 110. The sixth button 414 may be configured to enable the vertically downward movement of the apron 110. The seventh button 416 may be configured to set a hopper and apron control system (shown in FIG. 5) in an auto mode.

In an exemplary embodiment of the present disclosure each of the first button 404, the second button 406, the third button 408, the fourth button 410, the fifth button 412, and the sixth button 414 on the keypad 402 may have a home position, a first control position and a second control position. When one or more of the first button 404, the second button 406, the third button 408, the fourth button 410, the fifth button 412, and the sixth button 414 are set to the first control position, the hopper and apron control system may actuate corresponding functions in the manual mode. When the one or more of the first button 404, the second button 406, the third button 408, the fourth button 410, the fifth button 412, and the sixth button 414 are set at the second control position the hopper and apron control system may actuate corresponding functions in auto mode.

It can be contemplated that the first button 404, the second button 406, the third button 408, the fourth button 410, the fifth button 412, and the sixth button 414 can be a rotary switch, a toggle switch, a radio dial, push button and the like. In an embodiment, the first button 404, the second button 406, the third button 408, the fourth button 410, the fifth button 412, and the sixth button 414 can be a push button. It can be implied that the push button can be depressed to a first depth to set the push button at the first control position, and the push button can be depressed further to a second depth, beyond the first depth, to set the push button at the second control position.

In an alternative embodiment of the present disclosure, the control panel 400 may have a touchpad with a one or more touch buttons for different functions.

Figure 5:
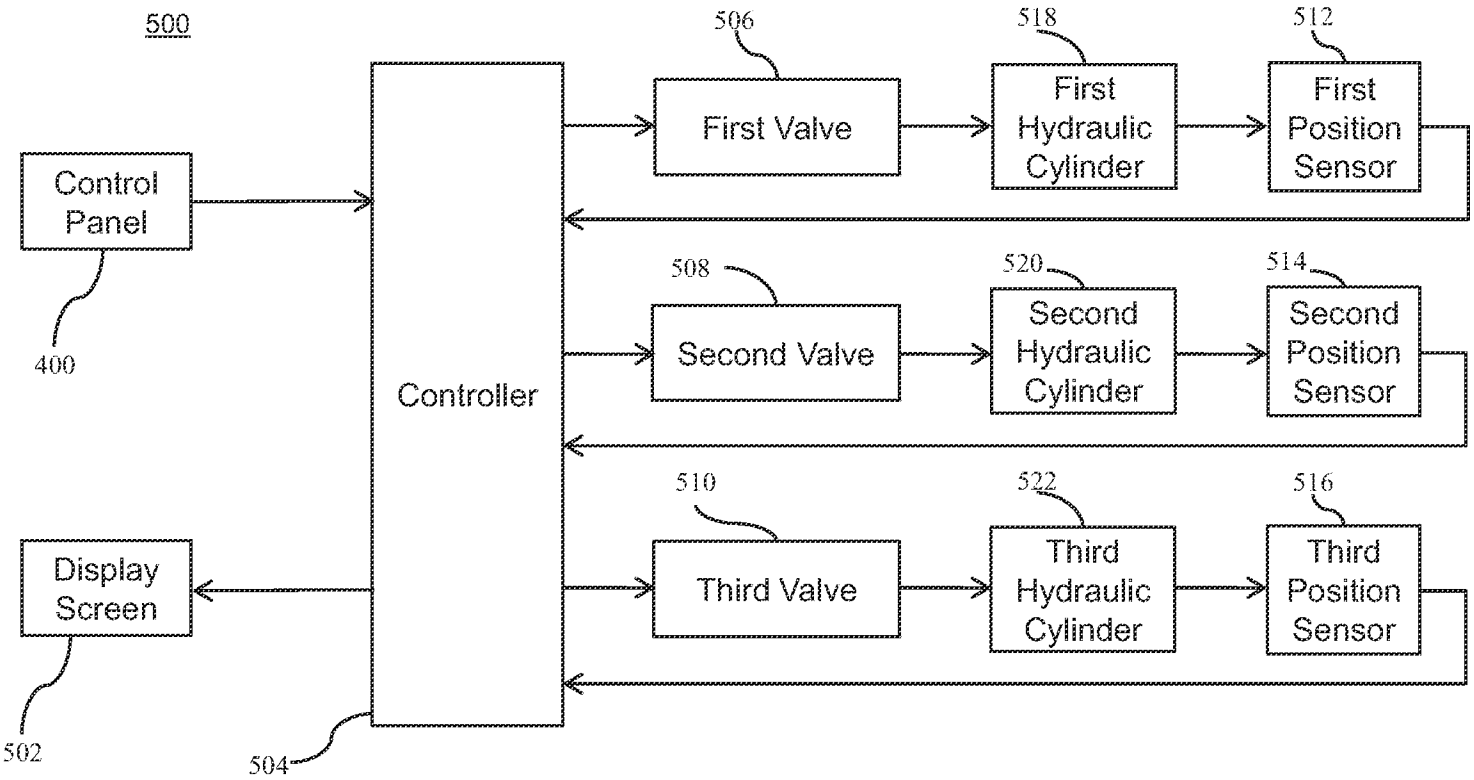
FIG. 5 is a block diagram illustrating a hopper and apron control system in accordance with an embodiment of the present disclosure.

FIG. 5 is a block diagram illustrating an automated hopper and apron control system 500 in accordance with an exemplary embodiment of the present disclosure. The automated hopper and apron control system 500 is herein after referred to as the control system 500.

The control system 500 may include the control panel 400, a display screen 502, a controller 504, a first valve 506, a second valve 508, and a third valve 510. The control system 500 may also include a first position sensor 512, a second position sensor 514, and a third position sensor 516 mounted on a first hydraulic cylinder 518, a second hydraulic cylinder 520, and a third hydraulic cylinder 522, respectively. In an embodiment of the present disclosure, the first position sensor 512, the second position sensor 514, and the third position sensor 516 can be configured to sense the retracted or extended position of the first hydraulic cylinder 518, the second hydraulic cylinder 520, and the third hydraulic cylinder 522, respectively.

The keypad 402 on the control panel 400 may be configured to actuate one or more of the right hopper 106, the left hopper 108 and the apron 110 according to an input provided by an operator. For example, the keypad 402 on the control panel 400 may actuate raising, lowering, extending, retracting or pivoting of the right hopper 106, the left hopper 108, and the apron 110 according to the input provided by the operator.

The control panel 400 may be configured to communicate with the display screen 502. The display screen 502 may be configured to display information based on height and slope of the right hopper 106, the left hopper 108 and the apron 110. The controller 504 may be configured to receive data related to height and slope of the right hopper 106, the left hopper 108 and the apron 110 from the one or more of the first position sensor 512, the second position sensor 514, and the third position sensor 516. In other words, the data related to the height and slope of the right hopper 106, the left hopper 108 and the apron 110, respectively, may be extracted based on positions of the first hydraulic cylinder 518, the second hydraulic cylinder 520, and the third hydraulic cylinder 522, respectively. The data of the positions of the first hydraulic cylinder 518, the second hydraulic cylinder 520, and the third hydraulic cylinder 522 may be extracted through the first position sensor 512, the second position sensor 514, and the third position sensor 516, respectively.

The first hydraulic cylinder 518, the second hydraulic cylinder 520, and the third hydraulic cylinder 522 may be actuated by a flow of a hydraulic fluid controlled by the first valve 506, the second valve 508, and the third valve 510, respectively. The flow of the hydraulic fluid in and out of the first hydraulic cylinder 518, the second hydraulic cylinder 520, and the third hydraulic cylinder 522 may cause expansion and contraction of the first hydraulic cylinder 518, the second hydraulic cylinder 520, and the third hydraulic cylinder 522, respectively. The expansion and retraction of the first hydraulic cylinder 518, the second hydraulic cylinder 520, and the third hydraulic cylinder 522 may cause movement of the right hopper 106, left hopper 108 and the apron 110, respectively.

In operation, an operator of the paving machine 100 with automated hopper and apron control system 500 may select to operate in manual or auto mode. In the manual mode, the operator of the paving machine 100 may actuate the right hopper 106 and the left hopper 108 from a first position to a second position in a vertical direction. The first position is referred to a position which may be the fully raised position, a fully lowered position, or between the fully raised position and the fully lowered position. The second position is referred to a desired position which may be vertically above or vertically below the first position, and may be the fully raised position, a fully lowered position, or between the fully raised position and the fully lowered position. For example, each of the right hopper 106 and the left hopper 108 are at the first position and the operator desires to actuate each of the right hopper 106 and the left hopper 108 from the first position to the second position. Here, the first position is referred to a position between the fully raised position and the fully lowered position and the second position refers to another position which is vertically above the first position and is short of the fully raised position. Prior to raising the right hopper 106 and the left hopper 108 from the first position, the operator may extract information on the current height at the first position of each of the right hopper 106 and the left hopper 108 from the display screen 502. Based on the information, the operator may depress the first button 404 and the third button 408 to a first control position to change the height of the right hopper 106 and the left hopper 108. During the vertically upward movement of each of the right hopper 106 and the left hopper 108, the operator continues to hold the first button 404 and the third button 408 at first control position till each of the right hopper 106 and the left hopper 108 attain the second position. The operator may release the first button 404 and the third button 408, when each of the right hopper 106 and the left hopper 108 attain the second position. In other words the operator may desire to raise or lower the right hopper 106, the left hopper 108, and the apron 110 to a desired height which may be mid way between the fully lowered position and the fully raised position. Hence, the operator is required to depress and hold both the first button 404 and the third button 408 at the first control position, till the time the desired height is achieved.

Further, the control system 500 may operate in an auto mode in accordance with an embodiment of the present disclosure. In an embodiment of the present disclosure the operator may activate the auto mode by pressing the seventh button 416 on the keypad 402 of the control panel 400. In another embodiment of the present disclosure, the operator may activate the auto mode by depressing one or more of the first button 404, the second button 406, the third button 408, the fourth button 410, the fifth button 412, and the sixth button 414 to a second control position for a predefined period of time. In another embodiment of the present disclosure, the auto mode may be activated by depressing at least two buttons of the first button 404, the second button 406, the third button 408, the fourth button 410, the fifth button 412, and the sixth button 414 beyond the first control point for a predefined period of time. In other words, the auto mode can be activated by depressing the seventh button 416 or by depressing any one or more of the first button 404, the second button 406, the third button 408, the fourth button 410, the fifth button 412, and the sixth button 414 to a second control position for a predefined period of time. A person skilled in the art would appreciate that the auto mode of the control system 500 may be activated by any other method without deviating from scope of the present disclosure.

In the auto mode, the vertically upward movement of the right hopper 106, the left hopper 108 and the apron 110 may be actuated by pressing the first button 404, the third button 408, and the fifth button 412, respectively. Similarly, the vertically downward movement of the right hopper 106, the left hopper 108 and the apron 110 may be actuated by pressing the second button 406, the fourth button 410, and the sixth button 414, respectively.

When the auto mode of the paving control system 500 is actuated, the control system 500 may keep operating until one or more of the right hopper 106, left hopper 108, and the apron 110 attain the fully raised position (as shown in FIG. 2) or the fully lowered position (as shown in FIG. 3), depending on input of the operator. In an embodiment of the present disclosure, the fully raised position and the fully lowered position of each of the right hopper 106, left hopper 108, and the apron 110 may be determined based on the data extracted from the first position sensor 512, the second position sensor 514, and the third position sensor 516, respectively. In an exemplary embodiment, the controller 504 may also actuate one or more of the first hydraulic cylinder 518, the second hydraulic cylinder 520, and the third hydraulic cylinder 522 for a predefined time interval such that the right hopper 106, the left hopper 108 and the apron 110, respectively, reach a fully lowered or fully raised position. The fully raised position and the fully lowered position of each of the right hopper 106, left hopper 108, and the apron 110 may be determined by various alternative ways.

In an embodiment of the present disclosure, the operator of the paving machine 100 may desire to adjust the height of the right hopper 106 and the left hopper 108 when at the first position between the fully raised position and the fully lowered position. The operator may press the seventh button 416 to activate the auto mode. Further, the operator may desire to move each of the right hopper 106 and the left hopper 108 from the first position to the fully raised position. The operator may actuate the right hopper 106 and the left hopper 108 in vertically upward direction by pressing the first button 404 and the third button 408, to a second control position and thereafter release first button 404 and the third button 408, respectively. Thereafter, control signals are sent to the controller 504 for actuation of the right hopper 106 and the left hopper 108. The controller 504 receives the control signals and generates command signals. The controller 504 sends the command signals to the first valve 506 and the second valve 508. The first valve 506 and the second valve 508 in response to the received command signals, may actuate the flow of a hydraulic fluid to the first hydraulic cylinder 518 and the second hydraulic cylinder 520, respectively. The flow of the hydraulic fluid extends the first hydraulic cylinder 518 and the second hydraulic cylinder 520. The extension of the first hydraulic cylinder 518 and the second hydraulic cylinder 520 moves the right hopper 106 and the left hopper 108 in the vertically upward direction from the first position to the fully raised position. Subsequently, the right hopper 106 and the left hopper 108 are in the fully raised position (as shown in FIG. 2). In the meanwhile, the first position sensor 512 and the second position sensor 514 sends the data related to the heights of the right hopper 106 and the left hopper 108, respectively, to the controller 504. Based on the data received by the controller 504, the controller 504 controls the display screen 502 to display the height of the right hopper 106 and the left hopper 108.

Further, the operator may desire to disable the auto mode of the paving control system 500 in the middle of an ongoing or active operation. For example, while operating, the operator may command to fully raise the right hopper 106. During the upward movement of the right hopper 106, the operator may desire to stop the further movement of the right hopper 106. In such a case, the operator may press the seventh button 416 to disable the auto mode. In another embodiment, the operator may depress the first button 404 to disable the auto mode. In this embodiment, the upward movement of the right hopper 106 may stop when the operator depressed the first button 404 or the seventh button 416. In other words, the auto mode may be disabled by depressing the seventh button 416 or by depressing one or more of the first button 404, the second button 406, the third button 408, the fourth button 410, the fifth button 412, and the sixth button 414 for a corresponding active upward or downward movement.

INDUSTRIAL APPLICABILITY

The disclosed paving machine 100 can be used in construction of driveways and roadways. The paving machine 100 may be used to serve purpose of leveling, compacting, spreading, and flattening of the material such as asphalt, on paving surfaces. The material may be dumped by a material dumping vehicle in the right hopper 106 and the left hopper 108 and the apron 110. In the given embodiments of the disclosure, the paving machine 100 may include the control system 500.

The disclosed control system 500 may operate in an auto mode or a manual mode. As set forth by an example, in an auto mode, the operator may be required to depress one or more of the a first button 404, a second button 406, a third button 408, a fourth button 410, a fifth button 412, a sixth button 414 to raise or lower the right hopper 106, the left hopper 108 and the apron 110. Once the respective button is the depressed, the right hopper 106, the left hopper 108 and/or the apron 110 may continue to move until a fully raised or fully lowered position is achieved. Hence, the operator may not be required to hold the button while the fully raised or fully lowered position is being achieved. Hence, the disclosed control system 500 with the auto mode may enable the operator to perform other tasks once the control system 500 actuates a particular operation; the operation is completed without the interference of the operator. The disclosed paving control system 500 may enhance productivity of the operator, and may also provide better ergonomics for the operator.

It should be understood that the above description is intended for illustrative purposes only and is not intended to limit the scope of the present disclosure in any way. Thus, those skilled in the art will appreciate that other aspects of the disclosure can be obtained from a study of the drawings, the disclosure, and the appended claim.

What is claimed is:

1. A paving machine comprising:

a right hopper configured to move in a vertically upward direction and a vertically downward direction from a first fully lowered position to a first fully raised position;

a left hopper configured to move in a vertically upward direction and a vertically downward direction from a second fully lowered position to a second fully raised position;

an apron configured to move in a vertically upward direction and a vertically downward direction from a third fully lowered position to a third fully raised position; and an automated hopper and apron control system, wherein the automated hopper and apron control system is configured to control the movement of the right hopper, the left hopper, and the apron, the automated hopper and apron control system comprising:

a first operator control button associated with automatically raising the right hopper to a first fully raised position;

a second operator control button associated with automatically raising the left hopper to a second fully raised position;

a third operator control button associated with automatically raising the apron to a third fully raised position;

a fourth operator control button associated with automatically lowering the right hopper to a first fully lowered position;

a fifth operator control button associated with automatically lowering the left hopper to a second fully lowered position;

a sixth operator control button associated with automatically lowering the apron to a third fully lowered position; and a controller in communication with the first operator control button, the second operator control button, the third operator control button, the fourth operator control button, the fifth operator control button, the sixth operator control button, the right hopper, the left hopper, and the apron, and configured to:

upon the actuation of the first operator control button, raise the right hopper to a first fully raised position;

upon the actuation of the second operator control button, raise the left hopper to a second fully raised position;

upon the actuation of the third operator control button, raise the apron to a third fully raised position;

upon the actuation of the fourth operator control button, lower the right hopper to a first fully lowered position;

upon the actuation of the fifth operator control button, lower the left hopper to a second fully lowered position; and upon the actuation of the sixth operator control button, lower the apron to a third fully lowered position.

2. The paving machine of claim 1, wherein as the controller raises the right hopper to a first fully raised position, upon actuation of the fourth operator control button the controller is further configured to:

stop raising the right hopper to a first fully raised position; and lower the right hopper to a first fully lowered position.

3. The paving machine of claim 2, wherein as the controller lowers the right hopper to a first fully lowered position, upon actuation of the first operator control button the controller is further configured to:

stop lowering the right hopper to a first fully lowered position; and raise the right hopper to a first fully raised position.

4. The paving machine of claim 3, wherein as the controller raises the left hopper to a second fully raised position, upon actuation of the fifth operator control button the controller is further configured to:

stop raising the left hopper to a second fully raised position; and lower the left hopper to a second fully lowered position.

5. The paving machine of claim 4, wherein as the controller lowers the right hopper to a first fully lowered position, upon actuation of the second operator control button the controller is further configured to:

stop lowering the left hopper to a second fully lowered position; and raise the left hopper to a second fully raised position.

6. The paving machine of claim 5, wherein as the controller raises the apron to a third fully raised position, upon actuation of the sixth operator control button the controller is further configured to:

stop raising the apron to a third fully raised position; and lower the apron to a third fully lowered position.

7. The paving machine of claim 6, wherein as the controller lowers the right hopper to a first fully lowered position, upon actuation of the third operator control button the controller is further configured to:

stop lowering the apron to a third fully lowered position; and raise the apron to a third fully raised position.

8. A paving machine comprising:

an apron configured to move in a vertically upward direction and a vertically downward direction from a fully lowered position to a fully raised position; and an automated apron control system comprising:

a control signal; and a controller; wherein when the controller receives the control signal, the controller moves the apron from a current position to a preset position.

9. The paving machine of claim 8, further comprising a sensor to measure the current position of the apron.

10. The paving machine of claim 8, wherein the preset position is the fully raised position.

11. The paving machine of claim 8, wherein the preset position is the fully lowered position.

12. The paving machine of claim 8, wherein the control signal is generated by an operator control button.

13. The paving machine of claim 9, wherein the controller moves the apron until the current position matches the preset position.

14. A paving machine comprising:

a right hopper configured to move between a first position and a second position;

a left hopper configured to move between a third position and a fourth position;

an apron configured to move between a fifth position and a sixth position; and an automated hopper and apron control system, wherein the automated hopper and apron control system is configured to control the movement of the right hopper, the left hopper, and the apron; the automated hopper and apron control system comprising:

a control signal; and a controller, wherein when the controller receives the control signal, the controller moves the apron from a current position to a preset position.

15. The paving machine of claim 14, further comprising a second control signal, wherein when the controller receives the second control signal, the controller moves the right hopper from a second current position to a second preset position.

16. The paving machine of claim 15, further comprising a third control signal, wherein when the controller receives the third control signal, the controller moves the left hopper from a third current position to a third preset position.

17. The paving machine of claim 14, wherein the preset position is the fifth position.

18. The paving machine of claim 14, wherein the preset position is the sixth position.

19. The paving machine of claim 14, wherein the preset position is between the fifth position and the sixth position.

20. The paving machine of claim 17, wherein the fifth position is when the apron is in a fully raised position.

* * * * *